US006755128B2

(12) United States Patent
Pane

(10) Patent No.: US 6,755,128 B2
(45) Date of Patent: Jun. 29, 2004

(54) MOVABLE DEVICE FOR COLLECTING AND CONVEYING SIGNATURES PRODUCED ON ROTARY PRINTING MACHINES

(75) Inventor: Mario Pane, Trino Vercellese (IT)

(73) Assignee: Officine Meccaniche Giovanni Cerutti S.p.A., Casale Monferrato (IT)

( * ) Notice: Subject to any disclaimer, the term of this patent is extended or adjusted under 35 U.S.C. 154(b) by 0 days.

(21) Appl. No.: 10/108,495

(22) Filed: Mar. 29, 2002

(65) Prior Publication Data

US 2003/0183100 A1 Oct. 2, 2003

(51) Int. Cl.[7] ..... B41F 13/54; B41F 13/64; B65H 29/00

(52) U.S. Cl. ..... 101/228; 101/232; 271/83; 271/187; 271/213

(58) Field of Search ..... 101/228, 225, 101/224, 227, 232; 271/187, 315, 83; 16/366, 302, 371, 330, 381; 403/312; 198/583, 584, 861.6

(56) References Cited

U.S. PATENT DOCUMENTS 86,581 A * 2/1869 Packer et al. ..... 403/312
4,242,773 A * 1/1981 Beigh ..... 16/371
4,934,264 A * 6/1990 Gansky et al. ..... 101/175
5,131,646 A * 7/1992 Balow ..... 271/187
5,236,188 A * 8/1993 Breton et al. ..... 271/187
5,241,905 A * 9/1993 Guaraldi et al. ..... 101/216
RE34,970 E * 6/1995 Tittgemeyer ..... 101/141
5,894,796 A * 4/1999 Gelinas ..... 101/219
5,915,441 A * 6/1999 Schlack ..... 16/371

* cited by examiner

*Primary Examiner*—Andrew H. Hirshfeld
*Assistant Examiner*—Leo T. Hinze
(74) *Attorney, Agent, or Firm*—Miles & Stockbridge P.C.; James T. Carmichael

(57) ABSTRACT

A "spider" device for collecting and conveying signatures produced on rotary print machines. The inventive device is adapted to be moved outside the production line without stopping operation of the production line. The device is equipped with a hinging mechanism adapted to connect it to a vertical riser of the production line for rotating it around at least one vertical axis with respect to the ground. The inventive device is further equipped with a hooking/unhooking mechanism used to allow repositioning the device in the same operating position in the production line.

1 Claim, 5 Drawing Sheets

MOVABLE DEVICE FOR COLLECTING AND CONVEYING SIGNATURES PRODUCED ON ROTARY PRINTING MACHINES

BACKGROUND OF THE INVENTION

1. Field of the Invention

The present invention refers to a movable device for collecting and conveying towards downstream working stations a flow of signatures incoming from an upstream format-cutting and bending line applied to rotary printing machines.

2. Background Information

The current rotary printing machines are composed of a plurality of devices mutually placed in series or in parallel in order to carry out the different operations through which a roller of a continuous web of a printing support (for example paper) is transformed into a magazine or the like, divided into suitably printed signatures, stacked and ready for being made into fascicles, to be bound, packaged, etc.

The invention refers to a part of the rotary printing machines that is shown in FIG. 1, which only shows the final part of the process, in which the fascicles have already been printed, cut and bent and appear as a continuous series, in a form in which a fascicle is spaced from the previous one and commonly it can be found in a parallel advancement to one or more fascicles of the same type. This situation is shown in FIG. 1 in a part of the line designated with reference 2, equipped with a set of advancement rollers, which will not be described in detail since they are known, and for conciseness.

Downstream of such station 2, one or a plurality (FIG. 1 shows three of them) of devices 1 are provided that are used for collecting and conveying the signatures produced by the printing machines. Such devices 1 are of the so-called "spider" type, because they are equipped with a plurality of curved blades 4 that uniformly project outside the cylindrical surface of the devices 1: through such blades 4, the devices 1 are adapted to collect the printed matter and to dispense it in batches (signatures) in such a way as to overlap every batch to the previous one with a degree of overlapping established according to the need of forming fascicles and binding downstream. The fascicles are thereby discharged onto suitable transporting means 3 already stacked and partially overlapped for being transported to downstream workings.

These spider-type devices 1, like all the parts of machines of this type, periodically need maintenance and setting operations. For the way in which they are placed in the machines (and that are connected fixed to support risers 9 and able to rotate around their longitudinal axis on fixed connecting pins), in case of maintenance, the operators, that must penetrate inside the printing machine to access to the devices 1, must stop the whole production line 5, also when, like in the case in FIG. 1, there are many devices 1 in series.

Moreover, in case it is necessary to intervene in the part of the machine designed with reference 6, that is in a vertical position immediately upstream of the device 1, it is necessary that the operator, once having stopped the machine, jumps over the device 1 in order to access the area 6, with various personal dangers and dangers of damaging the device 1 itself.

SUMMARY OF THE INVENTION

One of the objects of the present invention is solving the above prior-art problems, by providing a spider-type device in which it is possible to access maintenance and setting operations without having to stop the whole printing machine to which it is connected.

A further object of the present invention is providing a spider-type device of the above-mentioned type that can be taken out of the printing machine through a simple operation that requires a minimum effort by the operator, even if the weight of such spider-type device is high.

A further object of the present invention is providing a spider-type device of the above-mentioned type that can be completely taken out of the printing machine in such a way as to comfortably access also to parts of the machine that are immediately upstream thereof, and in such a way that it can be exactly repositioned in the same working position in which it was placed upon its previous removal.

The above and other objects and advantages of the invention, as will appear from the following description, are obtained by a spider-type device as claimed in claim 1. Preferred embodiments and non-trivial variations of the present invention are claimed in the dependent claims.

BRIEF DESCRIPTION OF THE DRAWINGS

The present invention will be better described by some preferred embodiments thereof, given as a non-limiting example, with reference to the enclosed drawings, in which.

DESCRIPTION OF A PREFERRED EMBODIMENT OF THE INVENTION

With reference to FIGS. 2 to 7, a preferred embodiment of the spider-type device 1 of the present invention will be described in detail, in an arrangement that allows it to be taken out of the production line 5 through a double rotation movement (of the pantograph type) around two different fulcrum points.

It is obviously possible, if the overall sizes so allow, to realise an arrangement in which the rotation of the spider-type device 1 is performed in a single movement around a single fulcrum point.

Figure 1:
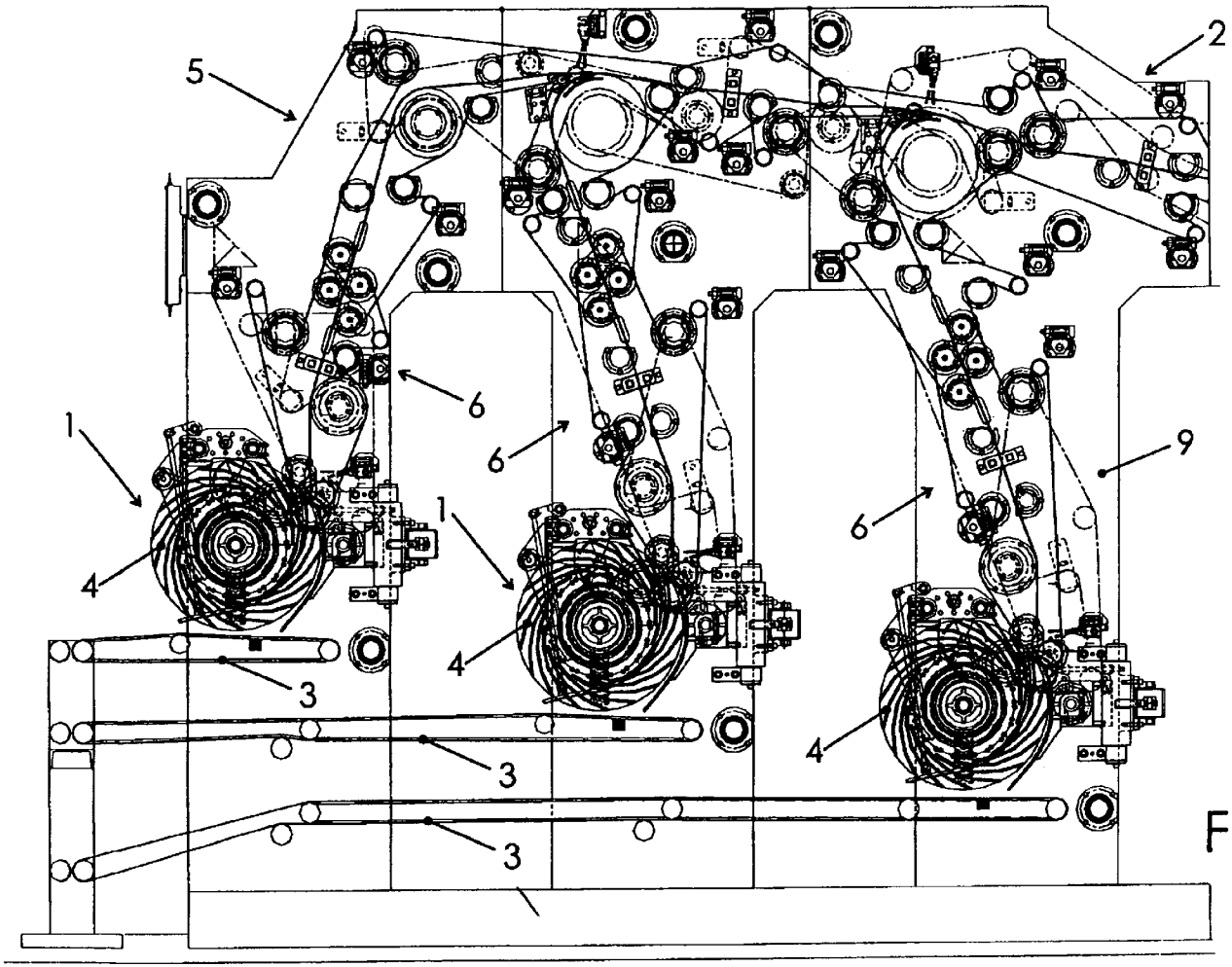
FIG. 1 is a partial side view of a collecting and conveying line for signatures produced on a previous format-cutting and bending line applied to rotary printing machines to which the device of the present invention is applied.

As shown in the Figures, the spider-type device 1 of the invention has as its main and major characteristic the one of being movable, namely that it is adapted to be moved outside the production line 5 of the printed matter without stopping the operation of the production line 5 itself. This obviously allows, as in the case shown in FIG. 1, stopping only one spider-type device 1 at a time, leaving the other two devices free of rotating and operating in series. Such movement also frees the space between the risers 9, in order to allow the operators to access also the interior between them, in order to allow more accurate and less dangerous maintenance operations.

In order to realise the above-mentioned characteristic, the spider-type device 1 of the invention is equipped with hinging means 6', 6" that connect one of its two ends 7 to one of the vertical risers 9 of the production line 5 in order to allow the spider-type device 1 to rotate around a vertical axis with respect to the ground. Moreover, the device 1 is equipped, at the opposite end 11 with respect to the hinging end 7, with hooking/unhooking means 14 to the production line 5.

In particular, according to an embodiment not shown, the hinging means 6', 6" could be composed of a hinge 6' connected to the riser 9 in such a way as to rotate the device 1 for an angle that is greater than 90° in a direction that takes the device outside a working direction of the production line 5.

Figure 2:
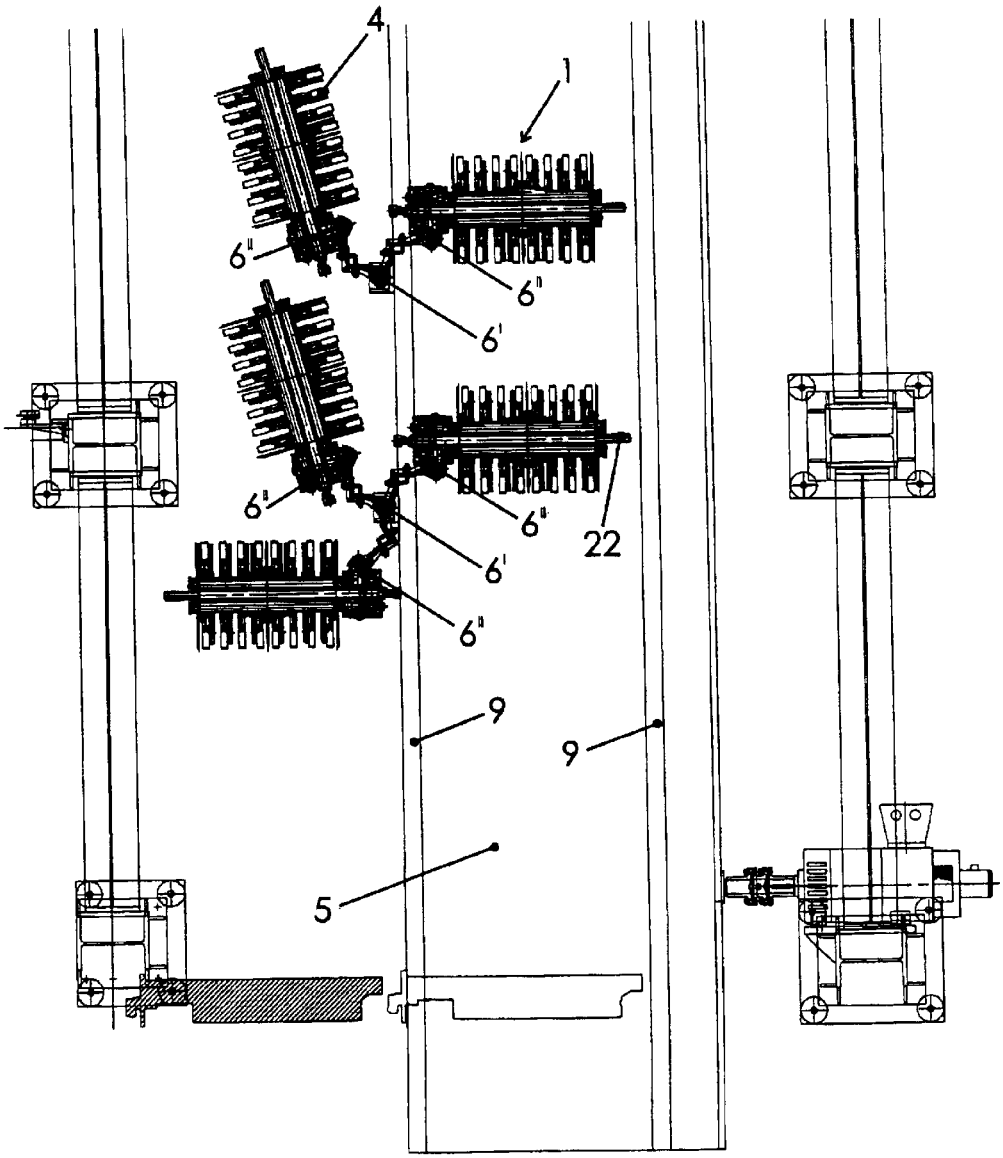
FIG. 2 is a top view of the device of the present invention, that shows also its steps of removal from the production line.
Figure 3:
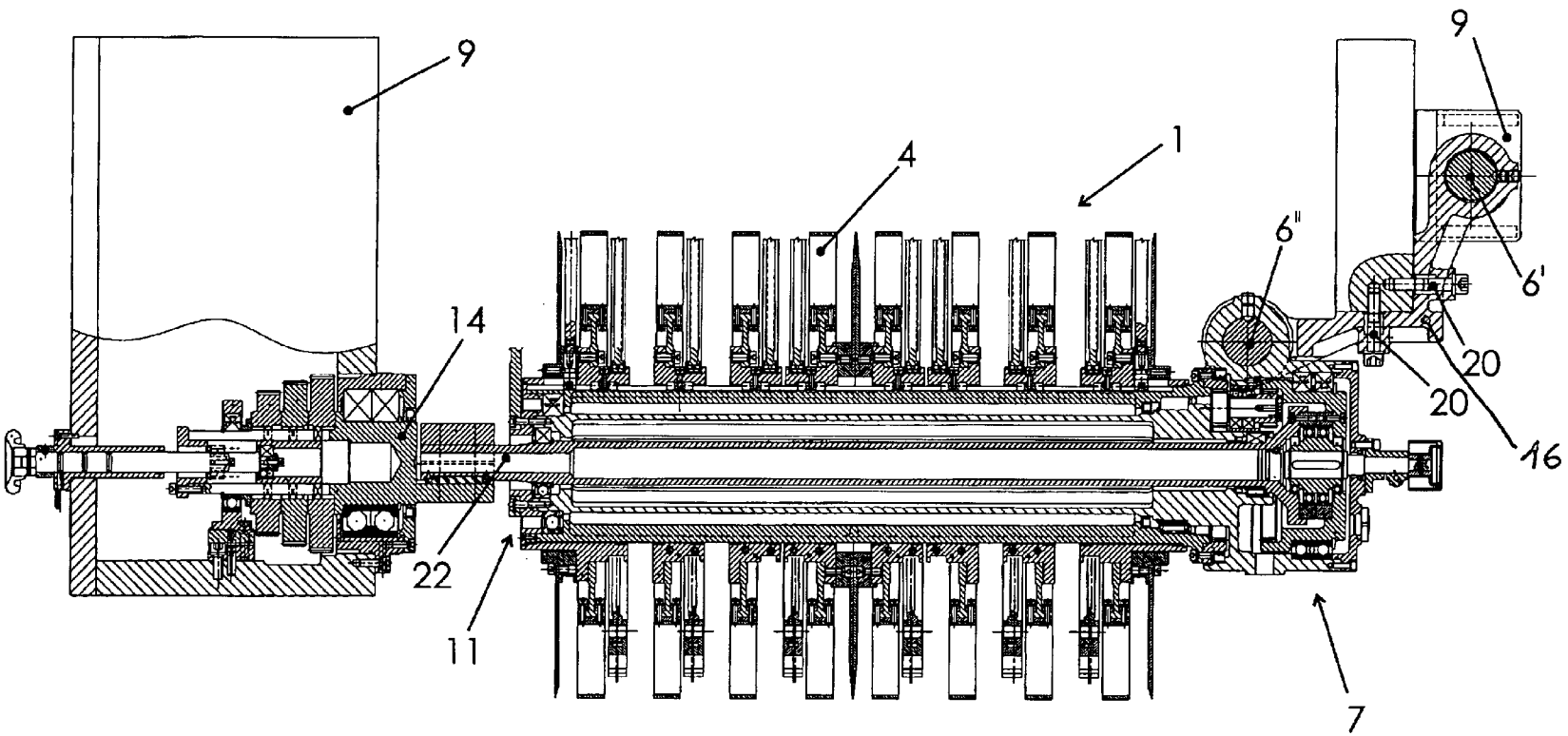
FIG. 3 is a detailed top view of the device of the present invention.
Figure 4:
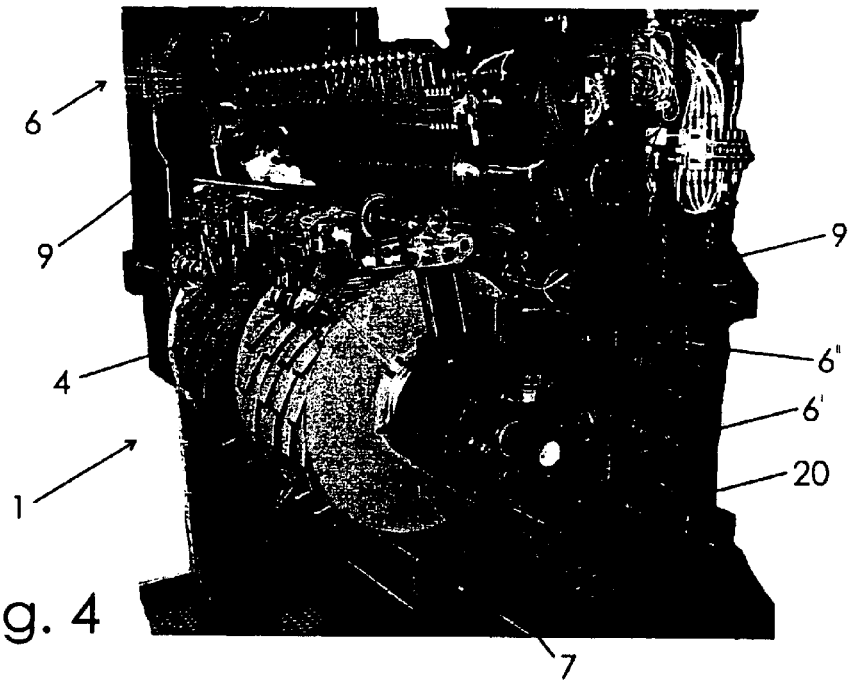
FIGS. 4 to 6 are perspective views that respectively show the working, partial removal and complete removal positions of the device of the invention.
Figure 5:
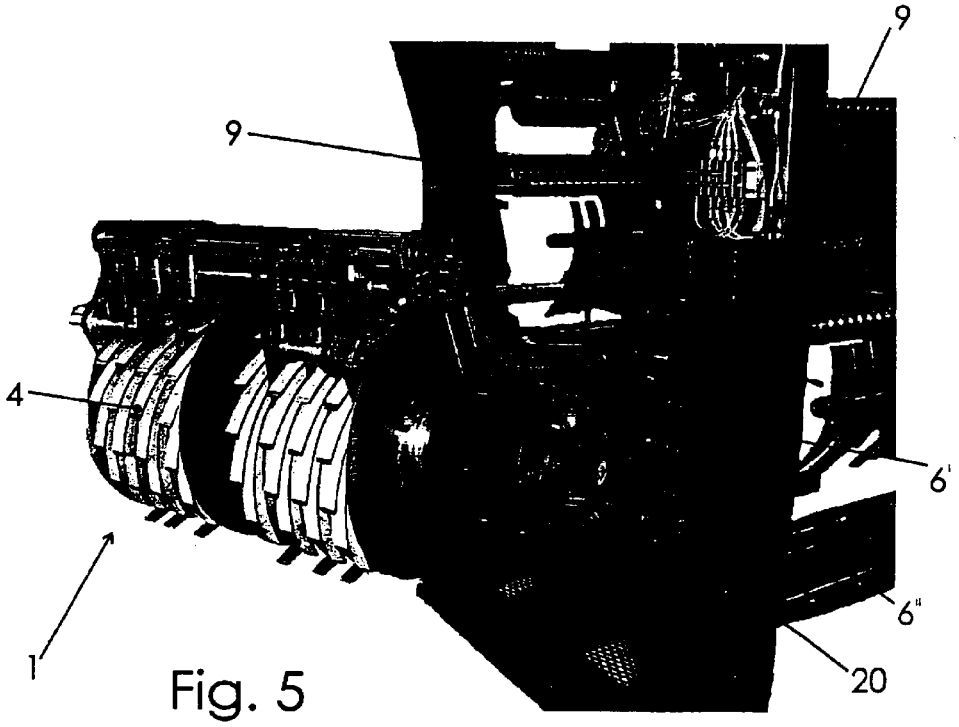
Figure 6:
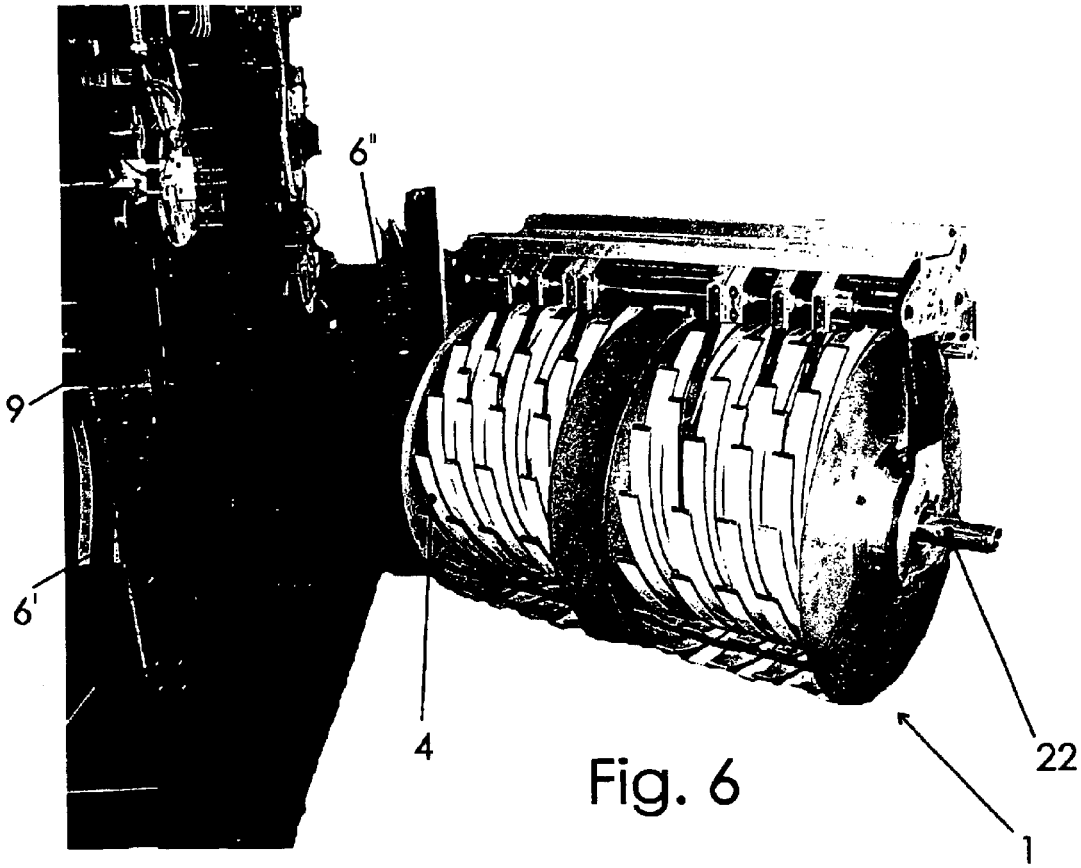

According to an alternative, also not limiting and shown in FIGS. 2 to 6, instead, the hinging means 6', 6" are composed of a first hinge 6' connected to the riser 9 and of a second hinge 6" linked (at connection point 16) to the first hinge 6': these hinges 6', 6" operate first in order to translate the device 1 to move its rotation fulcrum outside an encumbrance of the production line 5 and then in order to rotate the device 1 for an angle that is greater than 90° in a direction that takes the device outside a working area of the production line 5. These two translation and rotation movements are similar to those of a pantograph and are schematically shown in FIG. 2 and in FIGS. 4 to 6, that respectively show the working position of the device 1, a position of a first partial opening and a position of a second complete opening of the device 1 itself.

On the other side, according to a non-limiting embodiment shown, the hinging means 6', 6" are connected to the vertical riser 9 through securing elements 20 (commonly screws in a number not greater than 8) adapted to be unscrewed and screwed in order to respectively allow rotating and operatively securing the device 1.

Figure 7:
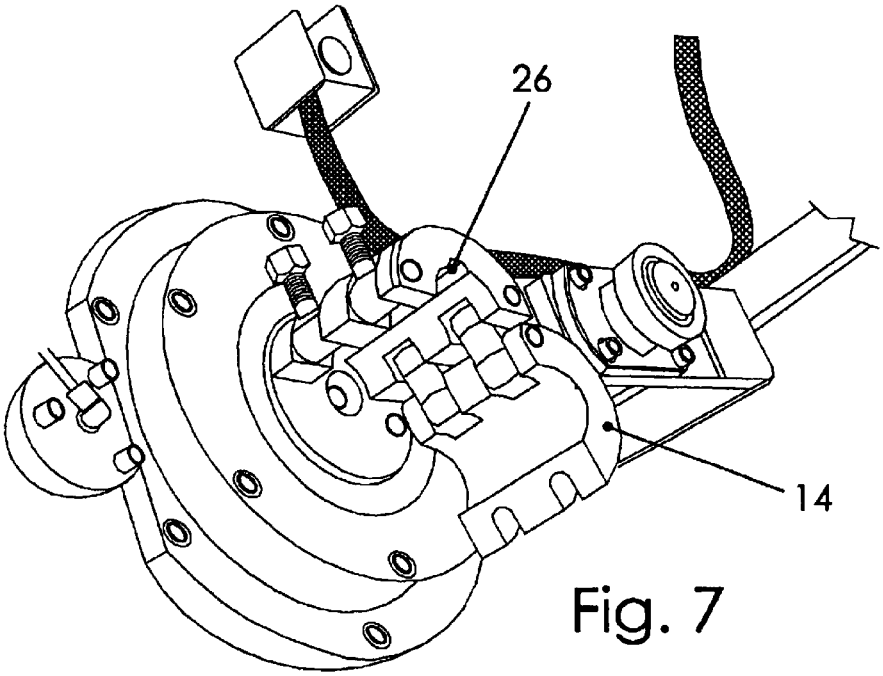
FIG. 7 shows in detail the hooking/unhooking means of the invention.

Further in particular, the hooking/unhooking means 14 are composed of a cylindrical sleeve 14 that surrounds the shaft 22 of said device 1: this sleeve 14 is adapted to be opened in half and to be closed onto the shaft 22 respectively in order to release and secure the device 1 in an operating phase (FIG. 7 shows the sleeve 14 in an opening phase). Finally, the hooking/unhooking means 14 are equipped with a fixed mechanical reference, for example a reference key (of which the related seat 26 is shown) adapted to allow reassembling the device 1 in a same operating position in which it was placed upon its removal from the production line 5.

What is claimed is:

1. A device for collecting and conveying signatures along a rotary printing machine production line coming from an upstream format-cutting and bending line, said device being of a "spider" type and being adapted to collect printed matter and to dispense it in batches in mutually partially overlapped positions to downstream transport means, said device comprising:

hinging means adapted to connect a first end of said device to a vertical riser of said production line in order to allow said device to rotate around at least one vertical axis with respect to a ground; and hooking/unhooking means adapted to latch and unlatch a second end of said device in place in the production line;

said device being rotatable about the at least one vertical axis to a position outside the production line without stopping operation of the production line, wherein said hinging means are adapted to connect to the vertical riser through at least one securing element adapted to be unscrewed and screwed in order to respectively allow rotating and operatively securing said device.

* * * * *